United States Patent [19]

Adams

[11] Patent Number: 4,723,568

[45] Date of Patent: Feb. 9, 1988

[54] HOSE REEL MECHANISM

[76] Inventor: Truman W. Adams, 810 North Gladstone, Indianapolis, Ind. 46218

[21] Appl. No.: 914,584

[22] Filed: Oct. 3, 1986

Related U.S. Application Data

[63] Continuation of Ser. No. 802,982, Nov. 29, 1985, abandoned, and a continuation-in-part of Ser. No. 628,740, Jul. 9, 1984, abandoned.

[51] Int. Cl.[4] ..... A62C 35/00

[52] U.S. Cl. ..... 137/355.17; 137/355.2; 242/77.2

[58] Field of Search ..... 137/355.17, 355.2, 355.16, 137/355.27, 355.23, 355.26; 242/77.2, 86, 86.2, 86.3, 86.6, 77

[56] References Cited

U.S. PATENT DOCUMENTS

| | | | |
|---|---|---|---|
| 1,746,995 | 2/1930 | Edwards | 137/355.17 |
| 1,819,707 | 8/1931 | German | 242/77.2 |
| 1,850,265 | 3/1932 | German | 242/77.2 |
| 2,795,385 | 6/1957 | Becker | 242/77.2 |
| 3,662,777 | 5/1972 | Plunkett et al. | 137/355.17 |
| 4,053,120 | 10/1977 | Fruntzreb, Sr. | 242/77.2 |
| 4,488,683 | 12/1984 | Chiel | 137/355.2 |

FOREIGN PATENT DOCUMENTS 307254 9/1937 Italy .

*Primary Examiner*—A. Michael Chambers
*Attorney, Agent, or Firm*—Woodard, Emhardt, Naughton, Moriarty & McNett

[57] ABSTRACT

A hose reel mechanism designed for carrying two separate, yet interconnected, lengths of hose includes a tubular metal frame which is provided with support wheels, a supporting base portion and a handle portion. Carried by this frame are two substantially identical hose reels, each of which are supported by an axle, the ends of each axle being secured by the sides of the frame. Each reel is designed to receive a length of hose wherein the hose disposed on the lower reel connects to the faucet and the hose on the upper reel is used for watering at a remote-use location. As the frame is moved away from the faucet, the hose wound on the lower reel is able to unwind automatically and once the frame is positioned at the desired location, the length of hose on the upper reel may be pulled at its free end for unwinding that hose from the top reel. When the watering activity is finished, the length of hose on the upper reel may be rewound onto that reel manually or alternatively by a spring-loaded mechanism, and the length of hose on the lower reel rewinds automatically as the frame is pushed back toward the faucet due to the driving action of the wheels and a belt and pulley arrangement which connects the wheel axle to the axle of rotation of the lower reel.

2 Claims, 16 Drawing Figures

HOSE REEL MECHANISM

REFERENCE TO RELATED APPLICATIONS

This application is a continuation of Ser. No. 802,982 filed Nov. 29, 1985 , now abandoned, and a continuation-in-part application of my previously filed application, Ser. No. 628,740, filed July 9, 1984, now abandoned. Applicant claims the benefit of that earlier filing date for all claims and claim elements herein which do not contain new matter.

BACKGROUND OF THE INVENTION

The present invention relates in general to hose reels used for the purpose of coiling a garden hose onto a spool so as to make storage, use and movement of the hose more convenient. More particularly, the present invention relates to a dual-reel mechanism wherein each reel retains a separate, though flow-connected, length of hose.

Typically, hose reels are used for the limited purpose of providing a hub or spool onto which the hose may be wound for the convenience of the user. In some instances, the reel is replaced by a partial reel or partial hub which may be fixed to the side of a structure, such as a house, or to a post. In these configurations, whether a reel or a partial reel is used, the purpose is to provide a support for the coiled hose. In other arrangements, the hose reel is carried by a hand cart, which is generally constructed of a tubular metal frame. The purpose of the hand cart, which is normally provided with a pair of wheels, is to enable the length of hose that is disposed on the reel to be moved about the yard or garden area more conveniently. In these arrangements, one end of the hose is connected to a faucet and the other end of the hose remains free while the length of hose in between the two ends is wound onto the reel.

Once the watering, washing, etc. activity is completed, the length of hose that was extended and unwound from the reel is then wound up onto the reel by hand. This is achieved by rotating the reel in the proper direction as the extended length of hose wraps itself on the hub of the reel, layer after layer. The rotation of the reel may be performed by directly moving the outer plate end of the spool or may be accomplished by the use of a hand crank.

One drawback of this type of design is the amount or length of hose which can be carried by the reel before the size of the reel becomes so large and cumbersome that it overwhelms the hand cart and makes recoiling of the hose onto the reel extremely difficult. As the hose is wound onto the hub of the reel, the additional layers of hose result in an ever-increasing outside diameter size. Due to the flexibility of the hose and its diameter size, there is also some limitation as to the starting diameter size of the hub of the reel. Consequently, there is a physical limitation as to what length of hose may be conveniently carried by a normally sized hose reel. In the event a gardener needs an additional length of hose, this length would have to be moved to a remote location at which point it would be connected to an initial length of hose and while both lengths may be carried by different hand carts, the activity must be repeated since it is not possible to bring both hand carts and reels to the same location simultaneously. Another drawback to the use of a single reel for an extended length of hose is the time and physical exertion required to repeatedly uncoil and rewind that increased length of hose onto the reel as the hose reel mechanism is used. This drawback is magnified as the length of hose increases.

Many variations and types of hose reel construction have appeared and representative examples of these variations and types are disclosed by the following group of patent references. Each reference pertains in one way or another to hose reel mechanisms, though some references are believed to be more relevant to the present invention than others.

| Patent No. | Patentee |
|---|---|
| 695,241 | Shaver |
| 1,418,575 | Iverson |
| 2,918,975 | Conery et al. |
| 1,043,647 | Wagner |
| 2,488,425 | Morrone |
| 3,587,626 | Cowley |
| 4,238,074 | Coons |
| 1,185,301 | Frank |
| 4,137,939 | Chow |
| 933,054 | Boswell |
| 2,590,963 | Hannay |
| 2,621,870 | Barton |
| 4,488,683 | Chiel |
| 3.233.543 | Germany (Ziegler) |
| 2.328.649 | France (Lang) |

Shaver discloses a combined reel and barrel carrier. FIGS. 1 and 2 of Shaver disclose a mechanism for driving the axle of a retention means 20 when a wheel 3 is rotatably driven. This drive mechanism comprises a sprocket chain 17 a sprocket pinion 16 and a sprocket wheel 15. A point of possible relevancy of this reference to the present invention is the fact that this drive mechanism is employed.

Iverson discloses a wire handling machine. FIGS. 1 and 2 of Iverson disclose a drive mechanism for rotatably driving the axle of a retention means 16 when wheels 14 are rotatably driven. This drive mechanism comprises sprocket chains 21 and 24 and sprocket wheels 22, 23, 19 and 20. Additionally disclosed by the drawings are a reel having a central hub or spool portion 16 and outlying discs 17 to prevent the wire from slipping off of the hub. While this construction is similar to the present invention as to the design of the reel and the concept of employing a mechanism for driving the reel when wheels are rotatably driven, these are the limits of relevancy of this particular reference to the present invention.

Conery discloses an apparatus for pumping liquids. FIGS. 5 through 10 disclose a vehicle for carrying a hose reel 47. To the extent that this reference discloses some type of vehicle for carrying a hose reel, it is relevant to the present invention, but its relevancy is believed to end at that point.

Wagner discloses a hose reel. FIG. 2 discloses a conduit D through the hub for allowing the water passing from the faucet through the length of the hose to be communicated to nozzle N. To the extent that the device disclosed in Wagner illustrates a hose reel with a central conduit passing through the hub it is relevant to the present invention, however the relevance of this reference is believed to end at that point.

Morrone discloses a combined hand truck and hose reel. FIGS. 1 through 4 disclose a hand truck frame with a pair of wheels 11 and a metal frame which has tubular end construction and which carries centrally thereto a hose reel rotatably mounted in the truck frame having a smaller central hub 14 and larger ends 16 so as to properly retain the length of hose wound about the central hub portion. To the extent that Morrone discloses a hose reel rotatably mounted upon a frame with wheels, it is believed to be relevant to the present invention.

Cowley discloses a transportable hose reel. FIGS. 1 through 7 are believed to be relevant as they disclose a reel 10 having a drum 14 and outlying circular flange members 18 and 20 at each end which serve not only to retain the hose, but serve the dual purpose of acting as wheels. The ends of the axles are rotatably mounted as shown in FIG. 5 and aligned openings provided in the hose reel frame structure at the intersection of two U-shaped tubular frame members which adjoin together in a 90° angle relationship. A short length of pipe is mounted on the frame adjacent to one end of the axle such that one of its ends projects axially into the tubular axle and carries two O-rings 90 and 92 which provide a removable seal. A discharge conduit 70 extends between the axle and the periphery of the drum to provide a connection to one end of a garden hose wrapped around the drum. To the extent that Cowley discloses a reel having circular flanges rotatably mounted upon a tubular frame in a 90° relationship to the frame, a tubular axle with O-rings for seals and a discharge conduit it is believed to be relevant to the present invention.

Coons discloses an attendant propelled portable spraying apparatus. FIGS. 1 through 3 illustrate a wheel cart 10 having an L-shaped frame and a reel 18 rotatably mounted thereto. The apparatus includes an inlet fitting 52 a check valve 60 and a variety of devices that are connected together in series and mounted in a manner so as to extend across the cart generally at the junction of the horizontal and vertical portions of the cart frame. The hose reel has a built-in, swivel-coupling type inlet for the hose and is journaled for rotation onto the hose reel. To the extent that Coons discloses a wheeled cart having an L-shaped frame, inlet fitting, check valve, and swivel coupling to allow for rotation of the hose reel upon the frame, it is believed to be relevant to the present invention.

Frank discloses a hose reel. FIGS. 1 and 2 disclose a U-shaped frame with wheels 4 and a reel rotatably mounted to the frame allowing for a hose to be automatically wound up as the mechanism moves across the ground. This particular device has only limited relevancy to the present invention, and that relevancy is limited to a frame member carrying a hose reel and supported by wheels for movement.

Chow discloses a hose reel cart. FIGS. 1 through 6 disclose a frame B, a rotatable reel C, and wheels D secured to the frame. The first full paragraph of column 6 describes an inlet assembly using O-rings to provide sealing and a means of fluid-type communication between the reel hub and an external supply of water. The aforementioned disclosed elements are believed to be the extent of relevancy of Chow to the present invention.

Boswell discloses a fence machine. FIGS. 1 and 2 disclose a belt 19 and pulley arrangement 9 and 11 coupling together the axle 7 of the drive wheel 8 and the axle 10 of a wire spool 17. The aspect of this particular device which may be the most relevant to the present invention is the fact that the device is configured to automatically wind up wire on the reel as the machine is moved on the ground.

Hannay discloses a hose reel construction. FIGS. 1 through 3 disclose a hose reel with a single reel and a hollow tube flow path construction 20. Hannay is relevant only in that it discloses some type of hose reel as well as an axle with a hollow flow path therethrough.

Barton discloses a hose reel assembly. FIGS. 1 and 2 illustrate two hose reels 5 driven by belts 8 for holding a fire hose on a truck. The relevance of Barton is limited to the disclosure of two hose reels supported on the same frame, it being noted that the hoses in Barton are not in flow communication with one another as is the case in the present invention.

Chiel discloses self-propelled irrigation equipment. FIGS. 1 and 2 illustrate a device with a reel for holding hose wherein the hose is automatically dispensed as the device moves along the ground by means of a pulley 44 and belt 45 arrangement. Chiel also discloses an idle arm for maintaining tension in the belt as well as a valve 9 for controlling flow communication. The disclosure of the previously stated elements are believed to be limited to relevancy of Chiel.

Ziegler, the German patent, discloses a fire hose double coiling mechanism that has an auxiliary reel driven via a free wheel initially accommodating one half of the hose. FIG. 1 discloses an apparatus with two hose reels 4 and 5 located on a frame that has ground engaging wheels 1. The relevancy of Ziegler is believed to be limited to the disclosure of a device that mounts two hose reels on a frame with wheel. It should be noted that Ziegler's is mainly a device for winding up hoses and not for flow communication between two different hoses disposed on separate reels.

Lang, the French patent, discloses a reel for garden hoses which has a water supply delivered to a rotatable connector on the end of the axle. FIG. 1 illustrates a hose reel 4 that is mounted on a bracket 2 which is carried on a pair of wheels 1. Lang further discloses that the hose reel has a central axle 3 which carries water to the hose connecting piece 5 from the main water supply. The connecting piece is rotatable with the end of the hose while the axle 3 remains stationary. The seal between the axle and the connecting piece consist of a fixture in a rotating bush and an O-ring. The end of the connector is fitted with a thread to take the hose adaptor. It is believed that the relevancy of Lang is limited to the disclosure of the previously cited elements.

Although the foregoing references disclose a variety of hose reel designs, it is to be noted that none reveal two separate sections of hose, interconnected but disposed on separate reels. This two-reel design is provided by the present invention and offers an improvement to earlier concepts because it allows two full-length sections of hose to be disposed on normally sized hose reels, carried by the same hand cart or frame. This allows twice the range for a single cart without increasing the size or weight of hose to be carried by a single reel. As a result, the reel sizes can be standardized and normal lengths of hose disposed on each one. However, the design of the present invention offers the advantages of a total hose length twice as long as what can conveniently be carried by a single reel due to size and weight limitations. In the present invention, one reel accommodates the length of hose which extends from the faucet to the hand cart and the other reel accommodates the length of hose which will be used from the hand cart as a central distribution point to a variety of remote watering locations. The flow connection for these two lengths of hose is fixed relative to the hand cart and flow conduits are built into the cart frame. What results is a most convenient and versatile design, not taught nor suggested by any of the earlier references. As should be understood, the upper hose reel can be replaced with a suitable hose-storage hook and still provide the double capacity described above.

With regard to the snap-fit hose reel embodiment which is disclosed, and comparing that style of hose reel to more conventional approaches, there is a tremendous savings with the present invention, both as to the cost of the stamping dies and the cost of eliminating approximately 60 spot welds which are required for these more conventional approaches. Further, due to this welding requirement, the unit cannot receive its final coating until after the unit is completely assembled. The completely assembled unit is bulkier and physically larger than the smaller individual pieces and thus it is more difficult and costly to apply the required coating. The snap-fit hose reel embodiment of the present invention overcomes each of these drawbacks which exist with more conventional hose reel concepts.

SUMMARY OF THE INVENTION

A hose reel mechanism designed for receiving a length of hose for communication between a source of fluid and a remote use location according to one embodiment of the present invention comprises a support frame arranged with a handle portion and a base portion, a pair of hose reels designed and arranged for receipt of a length of hose thereon, a pair of axles supported by the support frame wherein each axle extends through a corresponding reel and each is arranged for rotation of the corresponding reel relative to the support frame, a length of hose arranged into two portions with one of each portion disposed on a corresponding reel and an intermediate conduit providing flow communication between the two hose portions.

One object of the present invention is to provide an improved hose reel mechanism.

Related objects and advantages of the present invention will be apparent from the following description.

DESCRIPTION OF THE PREFERRED EMBODIMENT

Figure 1:
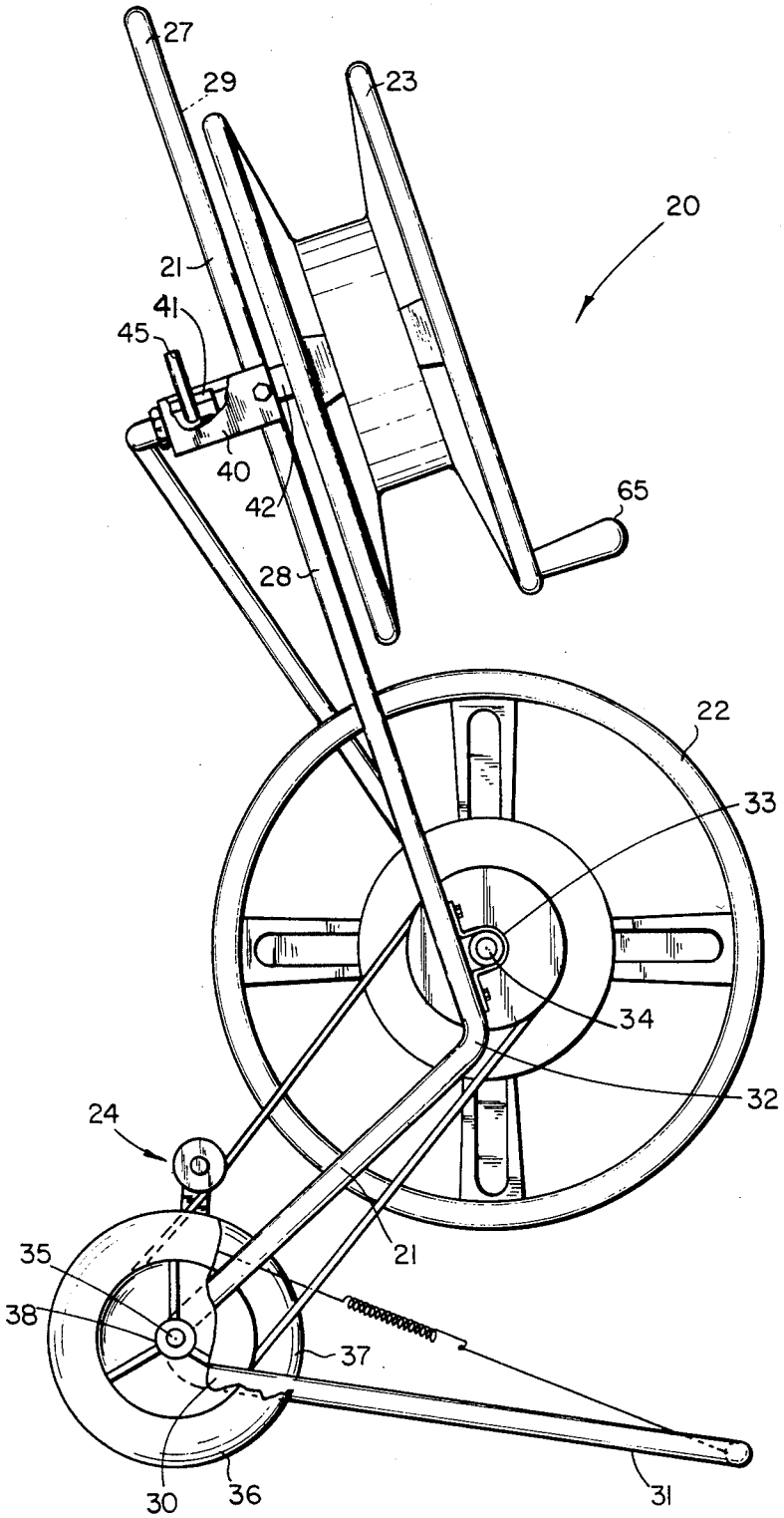
FIG. 1 is a side elevation view of a hose reel mechanism according to a typical embodiment of the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated devices, and such further applications of the principles of the invention as illustrated therein being contemplated as would normally occur to one skilled in the art to which the invention relates.

Figure 2:
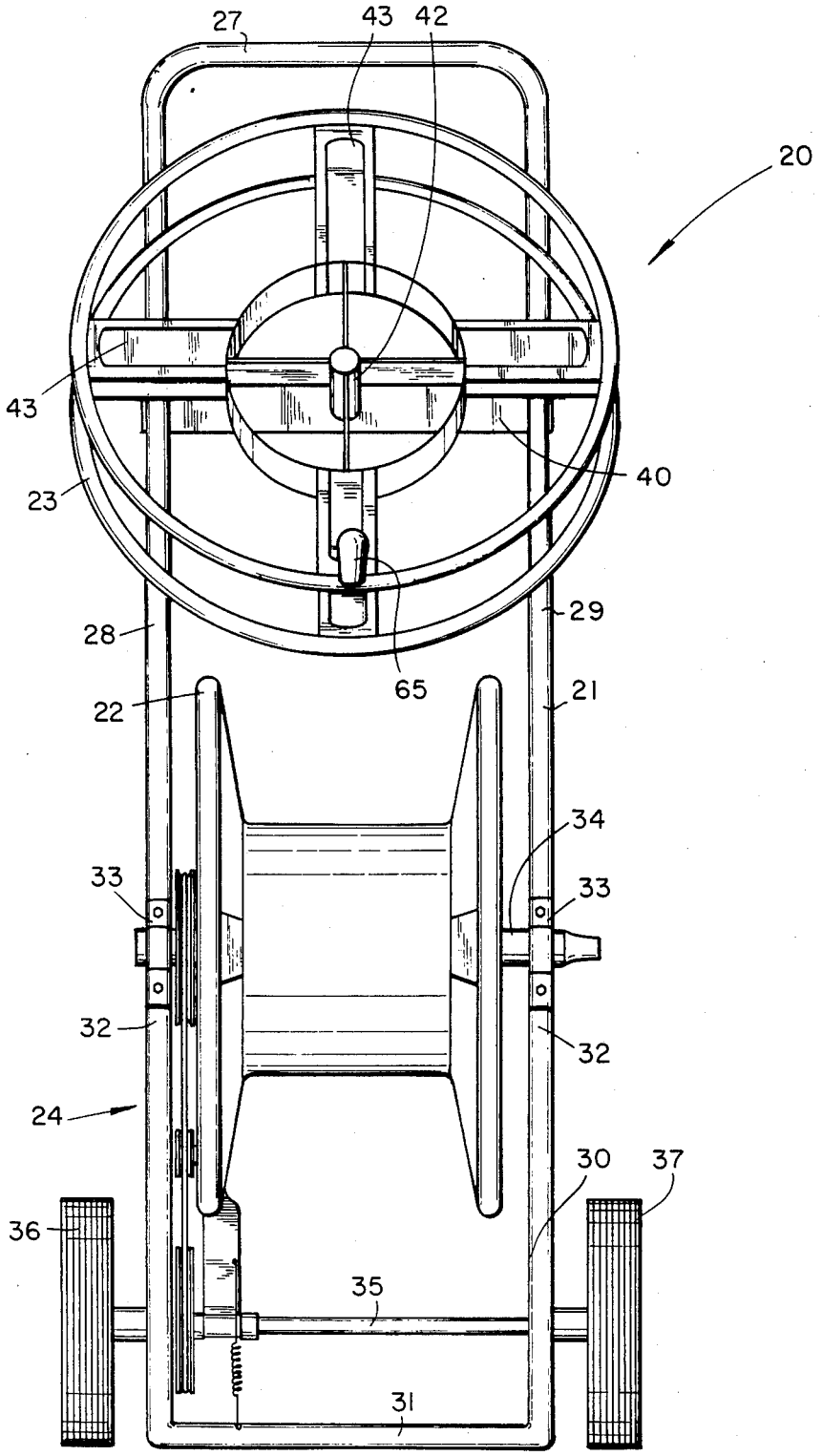
FIG. 2 is a front elevation view of the FIG. 1 hose reel mechanism.

Referring to FIGS. 1 and 2, there is illustrated one embodiment of a dual-hose reel mechanism 20 with the two lengths of hose that are used with the mechanism removed from their corresponding hose reels for drawing clarity. This removal of the hoses permits greater detail of the actual reel construction and how these reels are arranged relative to the frame. Mechanism 20 includes as its main component parts tubular metal frame 21, lower hose reel 22, upper hose reel 23, and pulley drive assembly 24.

The tubular metal frame which may be of unitary construction includes a handle portion 27, side portions 28 and 29, axle portion 30 and base portion 31. In the exemplary embodiment, the tubular metal frame consists of three separate sections which are telescopingly joined together and thereafter are secured in place by threaded fasteners. Directly above bend 32 on each side portion is a U-shaped bracket 33 which supports axle 34 about which reel 22 rotates. Centered on bend 38 of the axle support portion is a wheel axle 35 which extends the full width of frame 21 and receives at its opposite ends wheels 36 and 37 outwardly of the sides of the frame. Axle 34 and axle 35 are substantially parallel to each other and are substantially normal to the frame, though in the case of axle 34, the longitudinal axis of axle 34 does not intersect the frame.

Bolted to frame 21 and adjacent handle portion 27 is a support bracket 40 which receives a hollow conduit fitting 41 which is flow coupled to tubular support rod 42 which extends through the axial center of upper hose reel 23. A one-fourth turn control valve 45 is provided as part of fitting 41 and allows for the control of water flowing into the length of hose which is carried by reel 23. In this manner, the house faucet may be opened thereby providing a source of water to the first (lower)

section of hose which is disposed on the lower reel. Since the lower reel length of hose and that of the upper reel are interconnected, the water flowing through the lower hose is transferred to the upper section. By providing the quarter-turn control valve adjacent the upper reel, the user who may be at a remote location from the faucet is able to control when water is and is not delivered to the second length of hose.

The internal reel braces 43 form a central clearance aperture which receives rod 42 in a manner that permits rotation of reel 23 about the longitudinal axis of rod 42. A keyhole-shaped spring clip mates with a groove in rod 42 in order to lock the upper reel 23 in place on the tubular support rod. The longitudinal axis of rod 42 is substantially normal to the imaginary plane which receives the handle portion of the frame. This axis is non-parallel and non-intersecting with the longitudinal axis of axle 34, yet the planes of rotation of the two reels are substantially perpendicular to each other.

Conduit fitting 41 which is rigidly secured to bracket 40 includes at one end a threaded portion suitable for threaded receipt of a hose fitting. The opposite end of fitting 41 is coupled in flow communication to rod 42. The opposite end of rod 42 is provided with a threaded portion suitable for receipt of a hose fitting. In this manner, one length of hose is able to be connected to the fitting at one end of the rod and a different length of hose is able to be connected to the opposite end of the rod with flow communication therebetween being provided by the hollow nature of rod 42 and the hollow nature of fitting 41.

Lower hose reel 22 is supported by tubular axle 34 which in turn is clamped at its opposite ends to the metal frame 21 by brackets 33. In the exemplary embodiment, axle 34 is an assembly of various component parts which serve not only the purpose of supporting the reel and providing an axis of rotation for that reel, but as well provides in part for flow communication between the length of hose disposed on the upper reel and the length of hose disposed on the lower reel.

Figure 3:
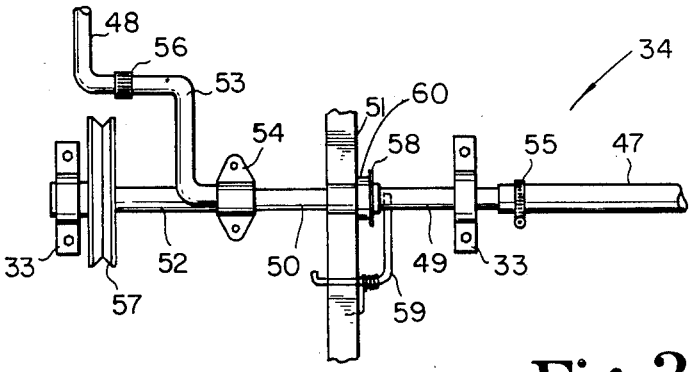
FIG. 3 is a front elevation detailed view of a center axle construction comprising a portion of the FIG. 1 hose reel mechanism.
Figure 4:
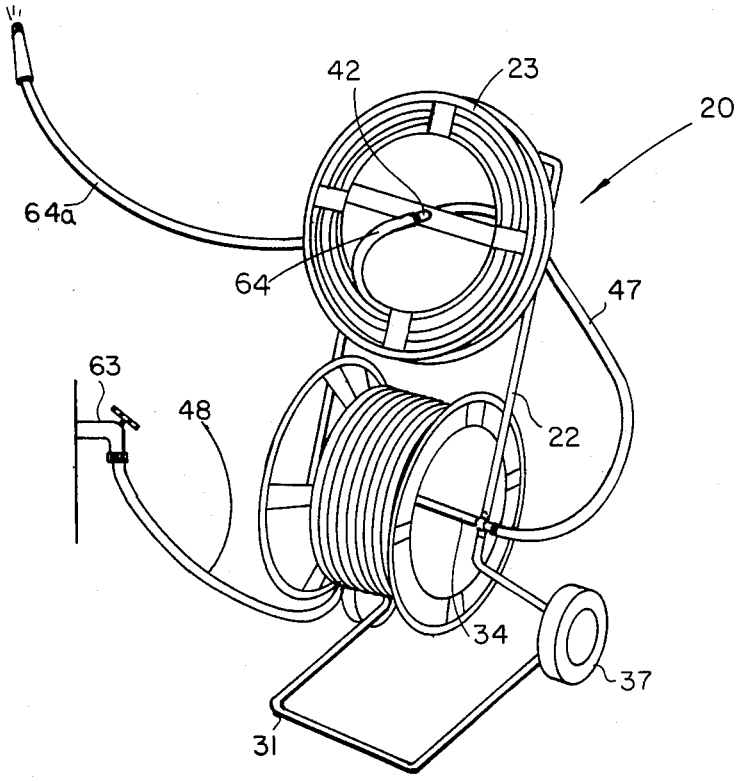
FIG. 4 is a schematic diagram of the hose-length-to-hose-length series connection employed as part of the FIG. 1 hose reel mechanism including the lengths of hose as wrapped on the two reels which comprise a portion of the FIG. 1 hose reel mechanism.

Referring to FIGS. 3 and 4, the specifics of the hose reel connections and flow path for the water are illustrated in greater detail. FIG. 3 is a detailed view of the construction of tubular axle 34. Additionally, included as part of this figure are brackets 33 and partial sections of hose 47 and hose 48. Axle 34 includes a first hollow conduit 49 which couples to center support conduit 50 which in turn is supported by reel frame support bracket 51. Axle 34 further includes pulley support rod 52, rigid hose section 53 and clamp 54. Although separately numbered, hose section 53 is an extension of conduit 50 and is of unitary construction therewith. Although rod 52 may be solid, conduit 50 and conduit 49 are each hollow and suitably connected by means of an O-ring fitting for flow communication so that hose 48 is in flow communication with hose 47. Hose clamp 55 secures hose 47 onto the tapered end of conduit 49 while threaded fitting 56 provides the connection between hose 48 and rigid hose section 53. Pulley 57 is rigidly received by rod 52, conduit 50, and bracket 51. Flange sleeve 58, which is secured to conduit 49 abuts against spacer 60 which is secured to and rigid with bracket 51. Spring-loaded clamping rod 59 holds conduit 49 in abutment against spacer 60. This sandwiched assembly maintains the lateral position of axle 34 relative to the frame while still permitting free rotation of the lower hose reel on axle 34 as is necessary for winding and unwinding of the length of hose that is carried by the lower hose reel.

As previously described, there are two lengths of hose, one each carried by a separate hose reel. While these lengths of hose were omitted from FIGS. 1 and 2 in order to disclose the internal construction of mechanism 20, these two lengths are illustrated in schematic form in FIG. 4 which details the points of connection for these two lengths as they extend from the faucet to the end-use location. One end of hose 48 is first coupled to fitting 56 and thereafter wound onto reel 22. The opposite end of hose 48 couples to faucet 63. In this manner, as the reel is moved away from the faucet, the hose is able to unwind from the reel. The water coming from the faucet flows through hose 48 and into the hollow, tubular portion of axle 34, ultimately exiting by way of conduit 49. Hose 47 is clamped at one end onto the end of conduit 49 and provides a connecting length of hose between the first main hose 48 which is disposed on reel 22 and the second main hose 64 which is disposed on reel 23. The other end of hose 47 is connected to tubular support rod 42 which in turn connects to hose 64. Hose 64, as it extends from rod 42, is wound onto reel 23 such that the free end **64*a* of hose 64 extends from the outer layer of windings. As a result of this winding approach, the hose 64 is able to be pulled from mechanism 20 allowing reel 23 to rotate as hose 64** unwinds as the free end of the hose is pulled farther and farther away from the location where the mechanism is stationed.

Use of mechanism 20 is contemplated in the following manner. The mechanism is first pulled to a somewhat central location in the garden or yard as it is pulled away from the faucet, which remains stationary as part of the structure or house. Hose 48 unwinds from reel 22 as the mechanism is moved away from the faucet location. After mechanism 20 is positioned in the desired location, as necessary hose 64 is manually unwound from reel 23 and extended to the remote location where water is required. Water flowing from the faucet passes through hose 48, axle 34, hose 47, rod 42 and ultimately through hose 64. Placement of the mechanism in the center of a yard or garden allows watering around the perimeter without having to move or relocate the mechanism.

Due to the size of some yards relative to faucet locations, a significant length of hose may be necessary in order to water outlying flowers, trees and shrubs. If a single reel is used for this purpose, its size will be quite large and the weight of the hose to be wound onto the reel substantial. By separating this overall hose length onto two reels, the smaller and standard reel size can be preserved while cutting the weight of hose on the reel to half of what would otherwise be required with a double-hose length. The connection between the two reels remains unaffected by the winding and unwinding of the two reels.

As illustrated, reel 23 is designed with a hand crank 65 for assistance in winding hose 64 back onto the reel. As an alternative to this approach, it is envisioned that reel 23 will be equipped with a spring return similar to that of a window blind so that the reel will automatically rewind when the hose is released.

Figure 5:
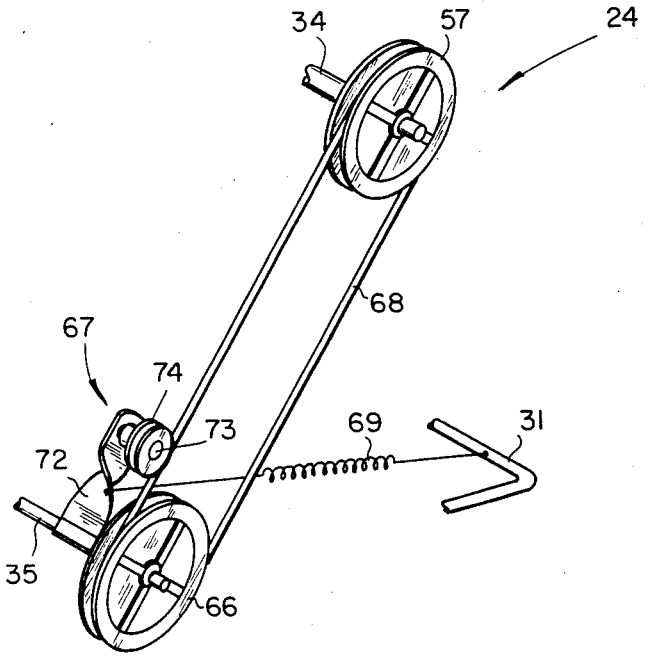
FIG. 5 is a perspective view of a belt and pulley assembly comprising a portion of the FIG. 1 hose reel mechanism.

Another feature of the invention is illustrated in FIG. 5 which discloses a belt and pulley drive assembly 24 which is arranged between wheel axle 35 and reel axle 34. This assembly includes pulley 57, pulley 66 which is attached to axle 35, idler 67, belt 68 and biasing spring 69. The idler is hinged to axle 35 by means of arm 72 and idler axle 73. Spring 69 pulls the idler pulley 74 downwardly so as to apply pressure to one portion of continuous belt 68 thereby taking up any slack which may be in the belt and creating a positive-drive arrangement between the two axles. Wheels 36 and 37 are configured relative to the rear axle 35 so as to drive the axle only when the wheels rotate in one direction. Since the wheels turn freely without turning the axle when rotated in the opposite direction, this allows the wheels to be pulled in one direction without transmitting any driving force to the lower hose reel. However, in the opposite direction of rotation for the wheels, the wheel axle 35 is driven by the wheels which in turn drives the belt and pulley drive assembly. Consequently, as the hose reel mechanism is pulled into the yard and away from the faucet, there is no drive action transmitted by the axle to the belt and pulley drive assembly. However, as the mechanism is pushed back toward the faucet, the rotation of wheels 36 and 37 drives their axle which drives pulley 66 which in turn drives pulley 57 resulting in the rotation of hose reel 22. As the hose reel rotates, it takes up the slack in the hose length and automatically rewinds the hose onto the reel simply by the action of pushing mechanism 20 back to its location near the faucet. Since the distance travelled across the ground by the mechanism for each revolution of wheels 36 and 37 remains constant, while the diameter of hose being wound up on the reel 23 increases due to the increasing diameter size of the hose on the reel, belt-to-pulley slippage must be provided as the mechanism draws closer to the location of the faucet and the diameter of hose being wound on the reel increases toward its maximum. This slippage is provided by the design of belt 68 relative to the two pulleys 57 and 66 and the tension of the idler. The material used for belt 68 is a polypropylene cord and the groove of each pulley is smooth, thus allowing slippage when the resisting force on the hose being wound exceeds the dynamic friction force between the belt and pulley. Idler 67 and spring 69 are adjustable in order to vary the frictional force between the belt and the pulley, but some slippage must be designed into the mechanism due to the amount of hose to be wound for each revolution of the wheels as the diameter of the wound hose on the hose reel increases.

Figure 6:
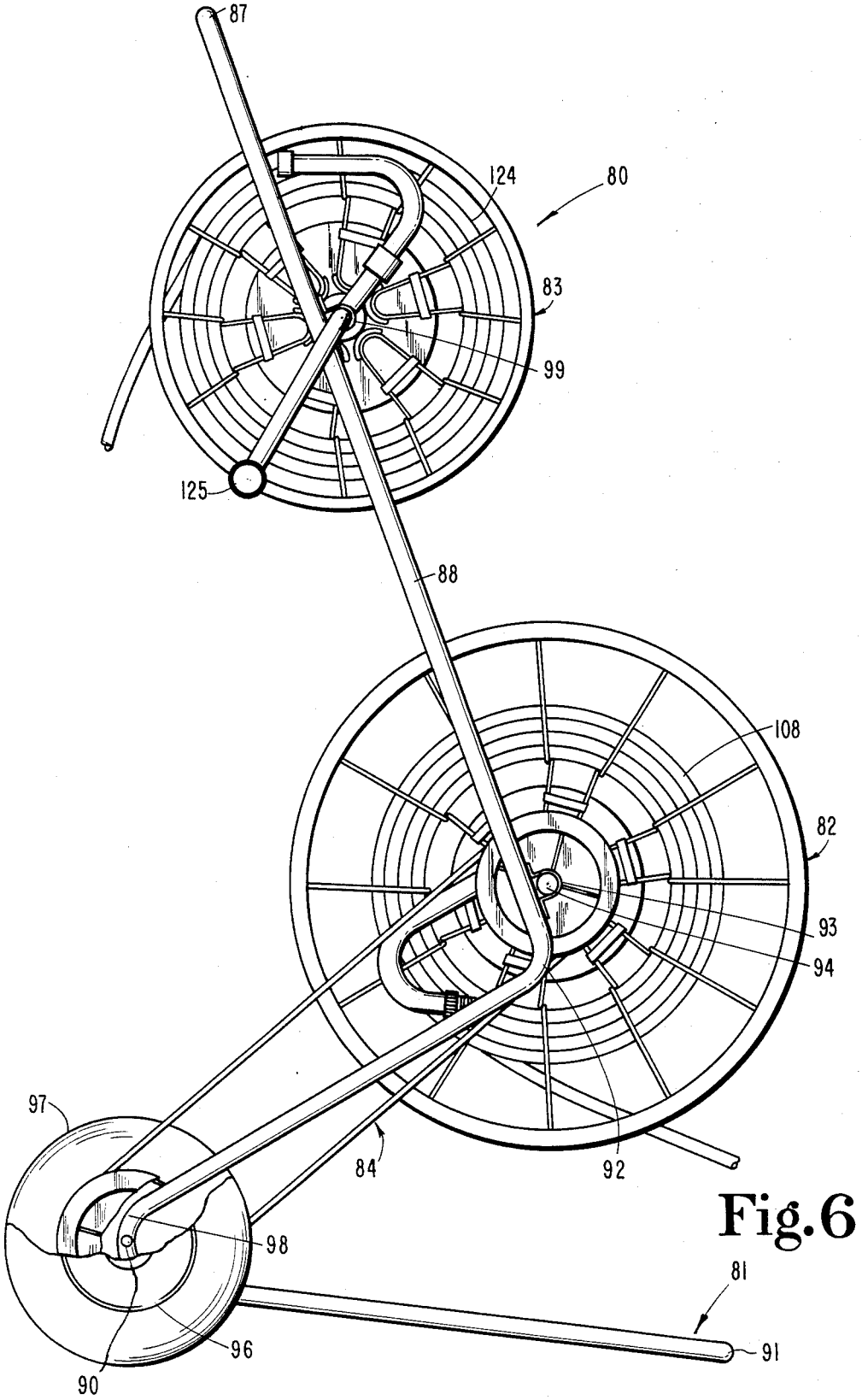
FIG. 6 is a side elevation view of a hose reel mechanism according to a second embodiment of the present invention.
Figure 7:
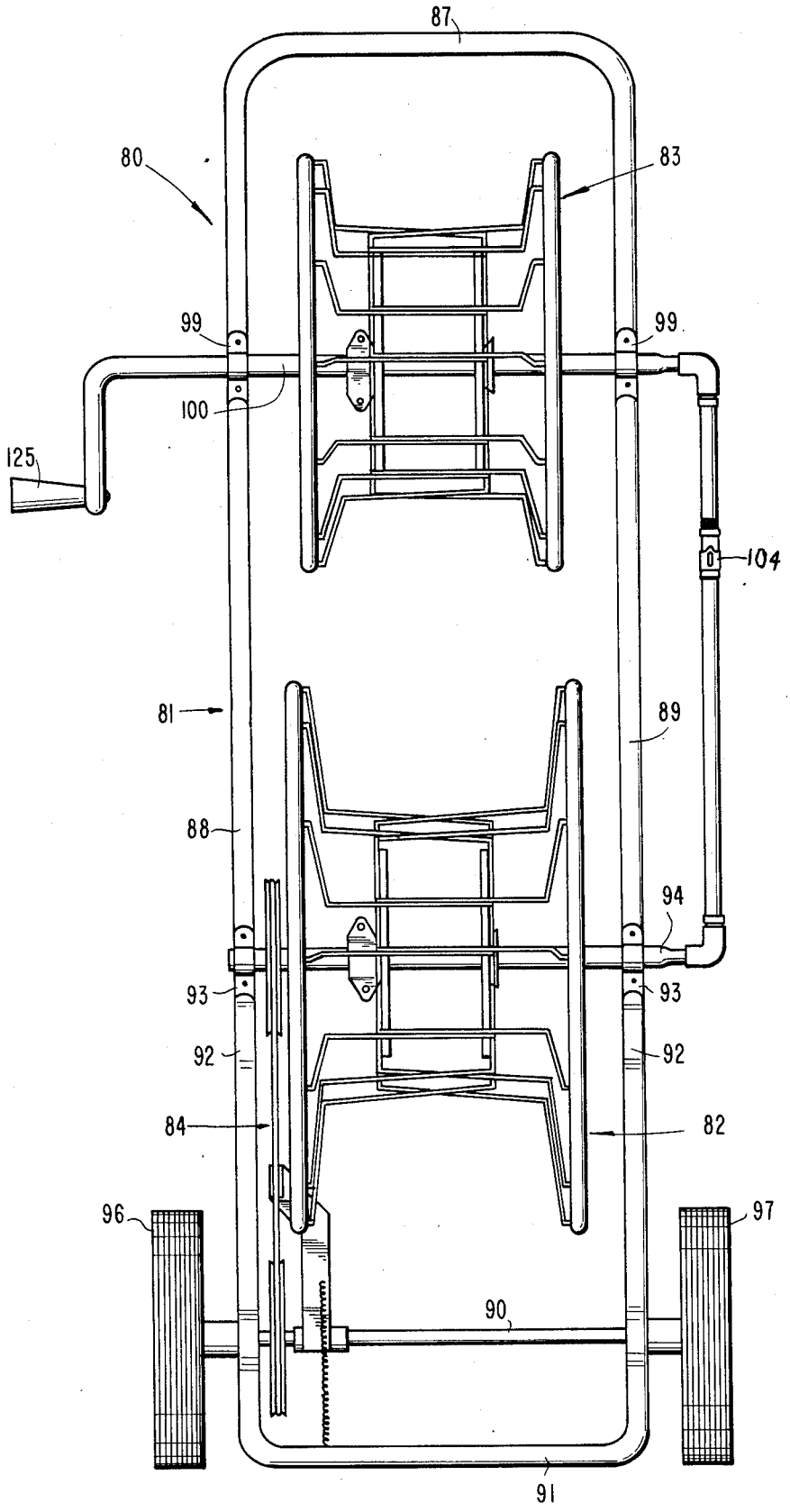
FIG. 7 is a front elevation view of the FIG. 6 hose reel mechanism.
Figure 8:
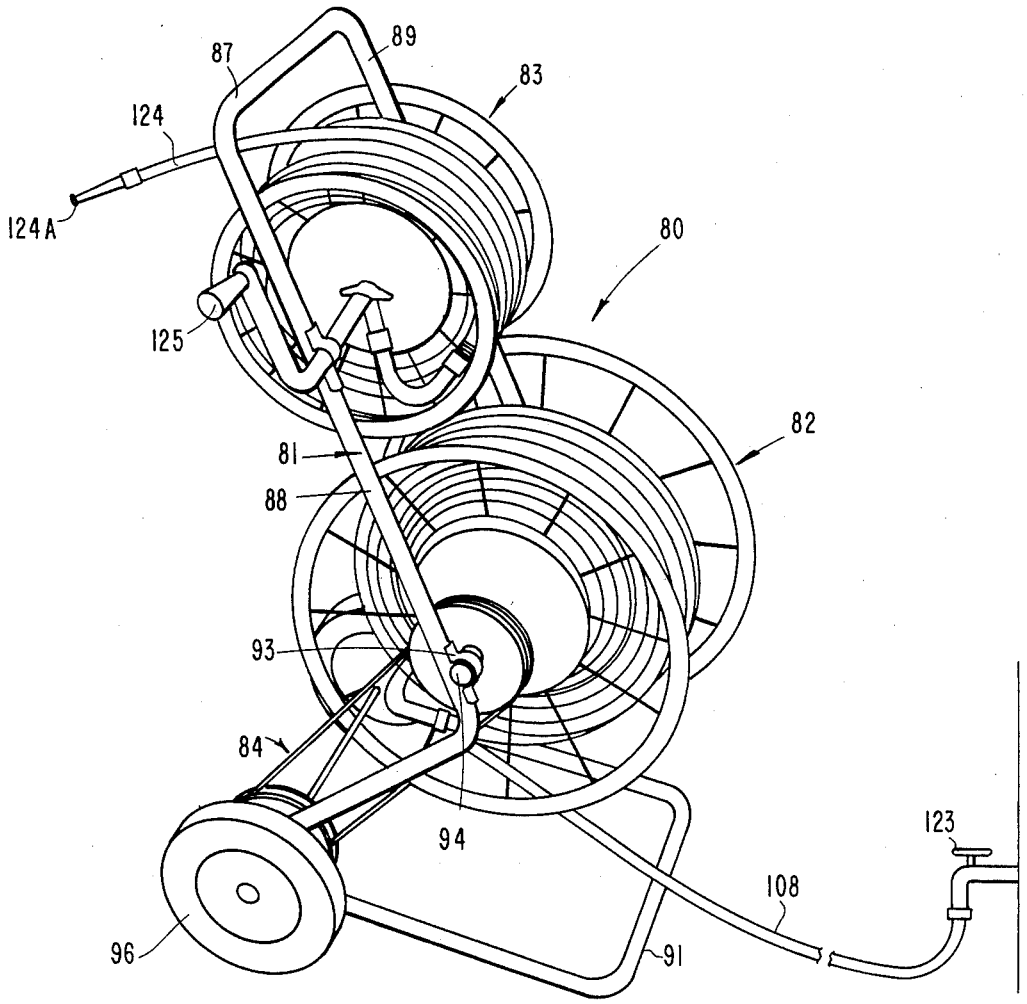
FIG. 8 is a schematic diagram of the hose-length-to-hose-length series connection employed as part of the FIG. 6 hose reel mechanism including the lengths of hose as wrapped on the two reels which comprise a portion of the FIG. 6 hose reel mechanism.

Referring to FIGS. 6, 7 and 8, there is illustrated a second embodiment of dual-hose reel mechanism 80 with the two lengths of hose that are used with the mechanism removed from their corresponding hose reels in FIG. 7 for drawing clarity. This removal of the hoses permits greater detail of the actual reel construction and how these reels are arranged relative to the frame. Mechanism 80 includes as its main component parts tubular metal frame 81, lower hose reel 82, upper hose reel 83, and pulley drive assembly 84.

The tubular metal frame 81 which may be of unitary construction includes a handle portion 87, side portions 88 and 89, axle portion 90 and base portion 91. In the exemplary embodiment, the tubular metal frame consists of three separate sections which are telescopingly joined together and thereafter are secured in place by threaded fasteners. Directly above bend 92 on each side portion is a U-shaped bracket 93 which supports axle 94 about which reel 82 rotates. Centered on bend 98 of the axle support portion is a wheel axle 90 which extends the full width of frame 81 and receives at its opposite ends wheels 96 and 97 outwardly of the sides of the frame. Axle 94 and axle 90 are substantially parallel to each other and are substantially normal to the frame, though in the case of axle 94, the longitudinal axis of axle 94 does not intersect the frame.

Located at a sufficient distance above U-shaped bracket 93 to allow for free rotation of upper hose reel 83 and lower hose reel 82 on each side portion is a U-shaped bracket 99 which supports axle 100 about which reel 83 rotates. Axle 94, axle 100 and axle 90 are substantially parallel to each other and are substantially normal to the frame, though in the case of axle 100 the longitudinal axis of axle 100 does not intersect the frame.

Lower hose reel 82 is supported by tubular axle 94 which in turn is clamped at its opposite ends to the metal frame 81 by brackets 93. In the exemplary embodiment, axle 94 is an assembly of various component parts which serve not only the purpose of supporting the reel and providing an axis of rotation for that reel, but as well provides in part for flow communication between the length of hose disposed on the upper reel and the length of hose disposed on the lower reel.

Upper hose reel 83 is supported by tubular axle 100 which in turn is clamped at its opposite ends to the metal frame 81 by brackets 99. In the exemplary embodiment, axle 100 is an assembly of various component parts which serve not only the purpose of supporting the reel and providing an axis of rotation for that reel, but as well provides in part for flow communication between the length of hose disposed on the upper reel and the length of hose disposed on the lower reel.

Figure 9:
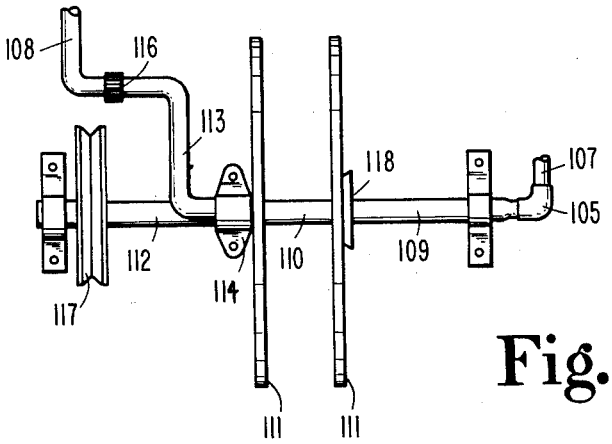
FIG. 9 is a front elevation detailed view of a center axle construction comprising a portion of the FIG. 6 hose reel mechanism.

Referring to FIGS. 7 and 9, the specifics of the hose reel connections and flow path for the water are illustrated in greater detail. FIG. 9 is a detailed view of the construction of tubular axle 94, it being understood that the description hereunder relating to tubular axle 94 applies equally to tubular axle 100 except that tubular axle 100 does not contain a pulley, such as pulley 117. Additionally, included as part of this figure are brackets 93 and partial sections of hose 107 and hose 108. Axle 94 includes a first hollow conduit 109 which couples to center support conduit 110 which in turn is supported by reel frame support brackets 111. Axle 94 further includes pulley support rod 112, rigid hose section 113 and clamp 114. Although separately numbered, hose section 113 is an extension of conduit 110 and is of unitary construction therewith. Although rod 112 may be solid, conduit 110 and conduit 109 are each hollow and suitably connected by means of an O-ring fitting for flow communication so that hose 108 is in flow communication with hose 107. Hollow elbow 105 secures hose 107 onto the tapered end of conduit 109 while threaded fitting 116 provides the connection between hose 108 and rigid hose section 113. Pulley 117 is rigidly received by rod 112, conduit 110, and bracket 111. Flange sleeve 118, which is secured to conduit 109 abuts against bracket 111. This sandwiched assembly maintains the lateral position of axle 94 relative to the frame while still permitting free rotation of the lower hose reel on axle 94 as is necessary for winding and unwinding of the length of hose that is carried by the lower hose reel.

As previously described, there are two lengths of hose, one each carried by a separate hose reel. While these lengths of hose were omitted from FIG. 7 in order to disclose the internal construction of mechanism 80, these two lengths are illustrated in schematic form in FIG. 8 which details the points of connection for these two lengths as they extend from the faucet to the end-use location. One end of hose 108 is first coupled to fitting 116 and thereafter wound onto reel 82. The opposite end of hose 108 couples to faucet 123. In this manner, as the reel is moved away from the faucet, the hose is able to unwind from the reel. The water coming from the faucet flows through hose 108 and into the hollow, tubular portion of axle 94, ultimately exiting by way of conduit 109. Hose 107 is clamped at one end onto hollow elbow 105 which in turn is attached to the end of conduit 109 and provides a connecting length of hose between the first main hose 108 which is disposed on reel 82 and the second main hose 124 which is disposed on reel 83. Located between the ends of hose 107 is a one-quarter turn valve 104 that controls the flow of water between hose 107 and hose 124. In this manner, the house faucet may be opened thereby providing a source of water to the first (lower) section of hose which is disposed on the lower reel. Since the lower reel length of hose and that of the upper reel are interconnected, the water flowing through the lower hose is transferred to the upper section. By providing the quarter-turn control valve, the user who may be at a remote location from the faucet is able to control when water is and is not delivered to the second length of hose. The other end of hose 107 is connected to the hollow elbow on the end of axle 100, which corresponds to hollow elbow 105 on axle 94, which in turn is flow connected to hose 124. Hose 124 is wound onto reel 83 such that the free end 124A of hose 124 extends from the outer layer of windings. As a result of this winding approach, the hose 124 is able to be pulled from mechanism 80 allowing reel 83 to rotate as hose 124 unwinds as the free end of the hose is pulled farther and farther away from the location where the mechanism is stationed.

Use of mechanism 80 is contemplated in the following manner. The mechanism is first pulled to a somewhat central location in the garden or yard. As the mechanism is pulled away from the faucet, which remains stationary as part of the structure or house, hose 108 unwinds from reel 82. After mechanism 80 is positioned in the desired location, hose 124 is manually unwound from reel 83 and extended to the remote location where water is required. Water flowing from the faucet passes through hose 108, axle 94, hose 107, axle 100 and ultimately through hose 124. Placement of the mechanism in the center of a yard or garden allows watering around the perimeter without having to move or relocate the mechanism.

Due to the size of some yards relative to faucet locations, a significant length of hose may be necessary in order to water outlying flowers, trees and shrubs. If a single reel is used for this purpose, its size will be quite large and the weight of the hose to be wound onto the reel substantial. By separating this overall hose length onto two reels, the smaller and standard reel size can be preserved while cutting the weight of hose on the reel to half of what would otherwise be required with a double-hose length. The connection between the two reels remains unaffected by the winding and unwinding of the two reels.

As illustrated, reel 83 is designed with a hand crank 125 for assistance in winding hose 124 back onto the reel. As an alternative to this approach, it is envisioned that reel 83 will be equipped with a spring return similar to that of a window blind so that the reel will automatically rewind when the hose is released.

Figure 12:
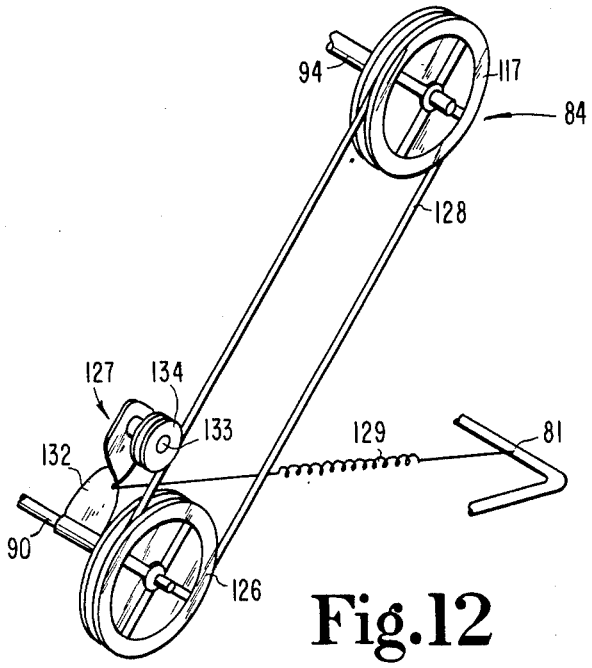
FIG. 12 is a perspective view of a belt and pulley assembly comprising a portion of the FIG. 6 hose reel mechanism.

Another feature of the invention is illustrated in FIG. 12 which discloses a belt and pulley drive assembly 84 which is arranged between wheel axle 90 and reel axle 94. This assembly includes pulley 117, pulley 126 which is attached to axle 90, idler 127, belt 128 and biasing spring 129. The idler is hinged to axle 90 by means of arm 132 and idler axle 133. Spring 129 pulls the idler pulley 134 downwardly so as to apply pressure to one portion of continuous belt 128 thereby taking up any slack which may be in the belt and creating a positive-drive arrangement between the two axles. Wheels 96 and 97 are configured relative to the rear axle 90 so as to drive the axle only when the wheels rotate in one direction. Since the wheels turn freely without turning the axle when rotated in the opposite direction, this allows the wheels to be pulled in one direction without transmitting any driving force to the lower hose reel. However, in the opposite direction of rotation for the wheels, the wheel axle 90 is driven by the wheels which in turn drives the belt and pulley drive assembly. Consequently, as the hose reel mechanism is pulled into the yard and away from the faucet, there is no drive action transmitted by the axle to the belt and pulley drive assembly. However, as the mechanism is pushed back toward the faucet, the rotation of wheels 96 and 97 drives their axle which drives pulley 126 which in turn drives pulley 117 resulting in the rotation of hose reel 82. As the hose reel rotates, it takes up the slack in the hose length and automatically rewinds the hose onto the reel simply by the action of pushing mechanism 80 back to its location near the faucet. Since the distance travelled across the ground by the mechanism for each revolution of wheels 96 and 97 remains constant, while the diameter of hose being wound up on the reel 82 increases due to the increasing diameter size of the hose on the reel, belt-to-pulley slippage must be provided as the mechanism draws closer to the location of the faucet and the diameter of hose being wound on the reel increases toward its maximum. This slippage is provided by the design of belt 128 relative to the two pulleys 117 and 126 and the tension of the idler. The material used for belt 128 is a polypropylene cord and the groove of each pulley is smooth, thus allowing slippage when the resisting force on the hose being wound exceeds the dynamic friction force between the belt and pulley. Idler 127 and spring 129 are adjustable in order to vary the frictional force between the belt and the pulley, but some slippage must be designed into the mechanism due to the amount of hose to be wound for each revolution of the wheels as the diameter of the wound hose on the hose reel increases.

Figure 10:
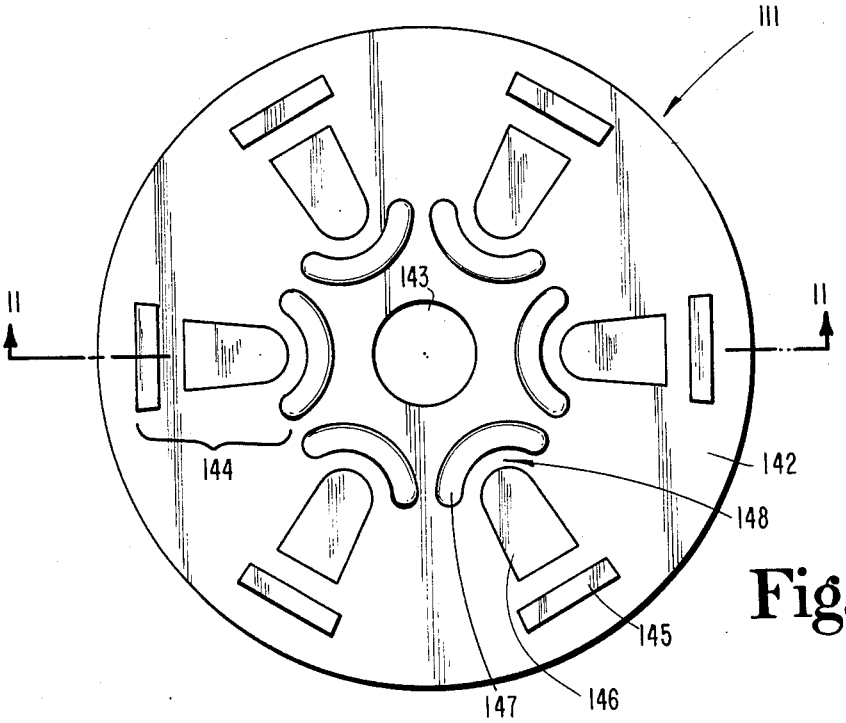
FIG. 10 is a front elevation view of one center hub comprising a portion of the FIG. 6 hose reel mechanism.
Figure 11:
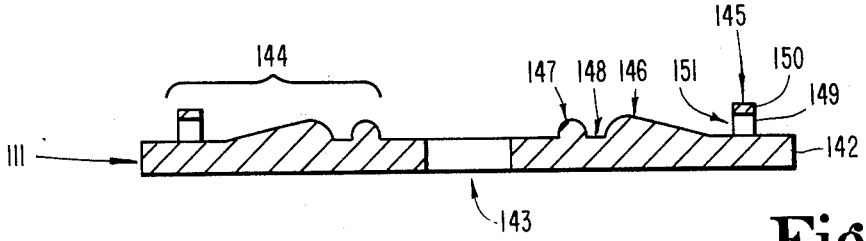
FIG. 11 is a cross-sectional view of the hub of FIG. 10 along the line 11—11 of FIG. 10.
Figure 13:
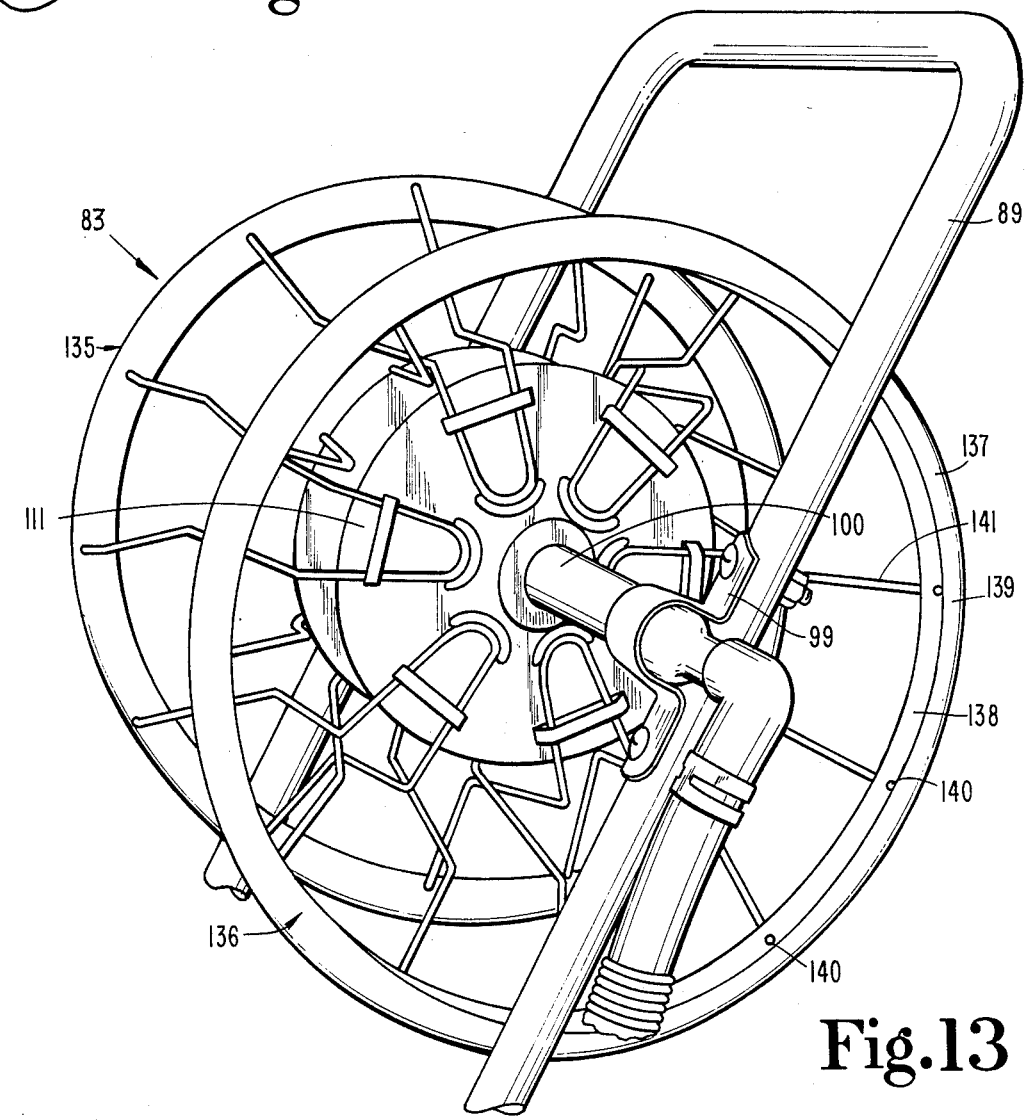
FIG. 13 is a perspective view of a hose reel comprising a portion of the FIG. 6 hose reel mechanism.

Another feature of the invention is illustrated in FIGS. 10, 11 and 13 which disclose the construction of hose reels 82 and 83. The construction of axles 94 and axle 100 have previously been described, therefore, the description of the hose reel will be limited to the reels themselves. It should be understood that hose reel 82 and hose reel 83 are of the same construction and therefore a description of hose reel 83 will be given with the understanding that the description applies equally to hose reel 82. Hose reel 83 has hose reel rims 135 and 136. Hose reel rim 136 will now be further described with the understanding that the description of hose reel rim 136 applies equally to hose reel rim 135. Hose reel rim 136 is constructed of a semi-tubular conduit 137 which is formed in a loop to define rim 136. Thus, hose reel rim 136 has a first wall 138 which is located nearer to the center of axle 100 than the second wall 139. Since hose reel 136 is constructed of semi-tubular conduit 137 there is a hollow space between first wall 138 and second wall 139. A plurality of holes 140 extend through first wall 138 to allow for receipt of one end of reel spokes 141.

Upper hose reel 83 consists of hose reel rims 135 and 136, a plurality of spokes 141 and two reel frame support brackets 111. Reel frame support brackets 111 will now be more particularly described. Reel frame support brackets 111 consist of a disc 142 with a hole 143 through the focus of the disc sized to receive center support 110 of upper reel axle 100. In the embodiment herein described, reel frame support brackets 111 have six spoke clamping assemblies 144 positioned about the disc so that when the disc is divided by any diameter line the disc is symmetrical about that line. Each spoke clamping assembly 144 consists of three parts, a spoke receiving bracket 145, a spoke retention sloping surface 146 and a spoke retention bead 147. Spoke retention sloping surface 146 and spoke retention bead 147 are positioned relative to one another so as to form a spoke receiving channel 148 with a width that approximates the diameter of the spoke 141 to be received therein. Spoke receiving bracket 145 has two sides 149 perpendicular to the surface of disc 142 and a top 150 extending between the sides 149. Spoke receiving bracket 145 is constructed so that the sides 149 are of appropriate length to ensure that the lower surface of top 150 is displaced, a distance approximating the diameter of the spoke 141 to be received, from the surface of disc 142 thereby defining an opening 151. Spoke retention sloping surface 146 is generally U-shaped and slopes gradually upward from the surface of the disc 142 in a direction away from spoke receiving bracket 145 towards hole 143 in the center of disc 142. The maximum surface displacement of sloping surface 146 from the surface of disc 142 approximates the diameter of the spokes 141 to be received. Spoke retention bead 147 has a maximum surface displacement from the surface of disc 142 which also approximates the diameter of spoke 141 to be received.

Figure 14:
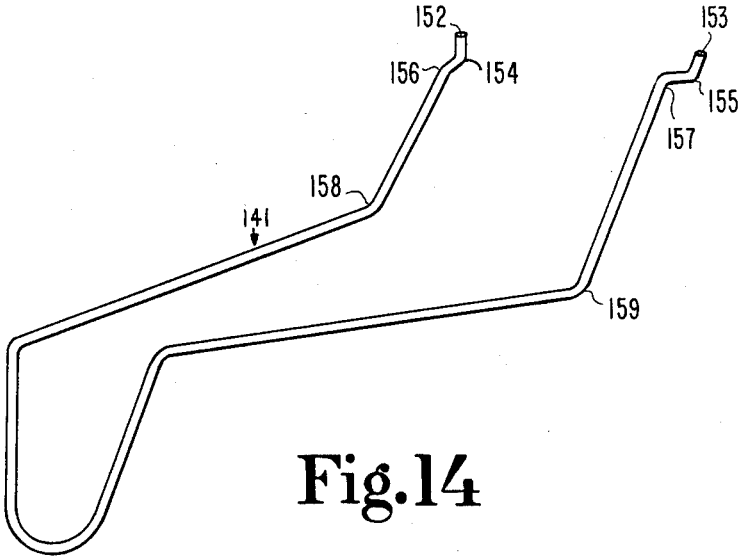
FIG. 14 is a perspective view of a spoke comprising a portion of the FIG. 6 hose reel mechanism.
Figure 15:
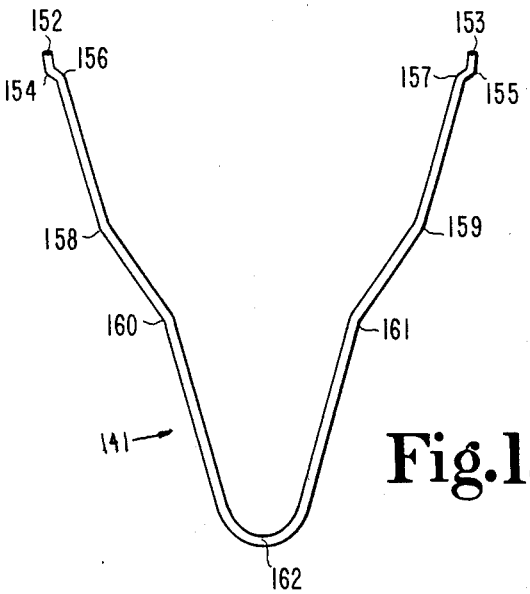
FIG. 15 is a front view of a spoke comprising a portion of the FIG. 6 hose reel mechanism.
Figure 16:
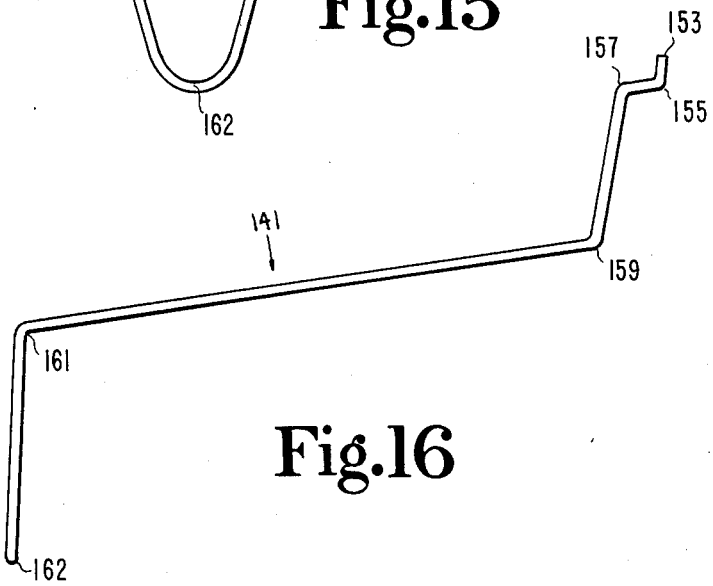
FIG. 16 is a side view of a spoke comprising a portion of the FIG. 6 hose reel mechanism.

Spokes 141 (FIG. 14) will now be further described. Spokes 141 are constructed of cylindrical material bent into the shape as illustrated in FIG. 14. It is envisioned that spokes 141 may be made from solid number 9 wire or other suitable material. Spoke 141 has two ends 152 and 153. At a distance from ends 152 and 153 less than the radius of the semi-tubular conduit 137 there are bends 154 and 155 in the spoke 141. At another distance approximating the distance from ends 152 and 153 to bends 154 and 155 there are other bends 156 and 157. Further along the wire at a distance defined by the effective size of the hose retention area are bends 158 and 159. Even further along the wire at a distance mandated by the width of the hose receiving area of the reel 82 are bends 160 and 161. A final U-shaped bend 162 which is shaped similar to the shape of spoke retention sloping surface 146 is formed at a distance from bends 160 and 161 sufficient to allow the U-shaped bend 162 to be received in spoke receiving channel 148 while bends 160 and 161 extend beyond the circumferential edge of disc 142. Referring to FIG. 13 the assembly of hose reel 82 is illustrated. Ends 152 and 153 of spoke 141 are inserted through adjacent holes 140 in the first wall 138 of rim 136 so that bends 154 and 155 are in contact with the inner section of first wall 138. Reel frame support bracket 111 are located on axle 110 so that the surfaces of the reel frame support brackets containing the spoke receiving bracket, spoke retention sloping surface and spoke retention bead face toward the nearest side 88 or 89 of the metal frame 81. Spokes 141 extend from rims 135 and 136 to the more distant of the reel frame support brackets. At the reel frame support brackets 111 the spokes 141 have been inserted through the spoke receiving brackets 145 bent over the spoke retention sloping surface 146 and are set in spoke receiving channels 148 and retained therein by spoke retention sloping surface 146 and spoke retention bead 147. This snap fit reel assembly is more economical than standard reel assemblies used in previous metal hose reel assemblies. This snap fit assembly structure is cheaper to manufacture in that not only are the materials cheaper, but also the need for intricate welding and metal stamping of the hose reel is avoided.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A hose reel mechanism designed for receiving two interconnected lengths of hose for communication between a source of fluid and a remote-use location comprises:

a support frame arranged with a handle portion and a base portion;

a first axle secured to said support frame;

a second axle secured to said support frame;

a first hose reel of a snap-fit construction disposed on said first axle and adapted for rotation relative to said support frame;

a second hose reel of a snap-fit construction disposed on said second axle and adapted for rotation relative to said support frame;

each of said axles having a hollow tubular portion provided with a hose fitting at one end;

an intermediate connecting conduit coupling the hollow portion of one axle to the hollow portion of the other axle for flow communication therebetween;

said first and said second hose reels each including a plurality of reel frame support brackets comprising a disc with an axle receiving means therethrough and spoke receiving means located on said disc for receiving spokes;

said spoke-receiving means comprising a spoke-receiving bracket, a spoke-receiving channel, and spoke retention means; and said spoke retention means includes a spoke retention sloping surface and a spoke retention bead which are located relative to one another so as to form said spoke receiving channel.

2. A hose reel mechanism designed for receiving two interconnected lengths of hose for communication between a source of fluid and a remote-use location comprises:

a support frame arranged with a handle portion and a base portion;

a first axle secured to said support frame;

a second axle secured to said support frame;

a first hose reel of a snap-fit construction disposed on said first axle and adapted for rotation relative to said support frame;

a second hose reel of a snap-fit construction disposed on said second axle and adapted for rotation relative to said support frame;

each of said axles having a hollow tubular portion provided with a hose fitting at one end;

an intermediate connecting conduit coupling the hollow portion of one axle to the hollow portion of the other axle for flow communication therebetween;

said first and said second hose reels each including a plurality of reel frame support brackets comprising a disc with an axle receiving means therethrough and spoke receiving means located on said disc for receiving spokes;

said spoke-receiving means comprising a spoke-receiving bracket, a spoke-receiving channel, and spoke retention means;

a plurality of spokes; and a first rim and a second rim, wherein said spokes are received in said spoke receiving channel and said spoke retention means and are removably attached to said first rim and said second rim.

* * * * *